US007677466B2

(12) United States Patent
Click et al.

(10) Patent No.: US 7,677,466 B2
(45) Date of Patent: Mar. 16, 2010

(54) INSULATED RAIL JOINT ASSEMBLY

(75) Inventors: Gary Click, Birmingham, AL (US); Brent Duffner, Pinson, AL (US)

(73) Assignee: VAE Nortrak North America Inc., Cheyenne, WY (US)

( * ) Notice: Subject to any disclaimer, the term of this patent is extended or adjusted under 35 U.S.C. 154(b) by 702 days.

(21) Appl. No.: 11/420,199

(22) Filed: May 24, 2006

(65) Prior Publication Data

US 2007/0272762 A1 Nov. 29, 2007

(51) Int. Cl.
*E01B 11/00* (2006.01)

(52) U.S. Cl. ..... 238/151

(58) Field of Classification Search ..... 238/151, 238/152, 160, 180, 182, 262, 263
See application file for complete search history.

(56) References Cited

U.S. PATENT DOCUMENTS

| | | | | |
|---|---|---|---|---|
| 1,174,478 | A | 3/1916 | Corey | |
| 1,269,714 | A * | 6/1918 | Kimack | 238/149 |
| 2,016,214 | A | 10/1935 | Payne | |
| 2,628,784 | A | 2/1953 | Payne | |
| 3,100,080 | A | 8/1963 | Fiechter | |
| 3,369,752 | A | 2/1968 | Youngward et al. | |
| 3,381,892 | A | 5/1968 | Eisses | |
| 3,837,948 | A | 9/1974 | Nelson et al. | |
| 4,061,270 | A | 12/1977 | Wandrisco | |
| 4,209,130 | A | 6/1980 | Sundsrud et al. | |
| 4,386,736 | A | 6/1983 | Benkler et al. | |
| 4,466,570 | A | 8/1984 | Howard | |
| 4,630,772 | A | 12/1986 | Watanabe et al. | |
| 4,773,590 | A | 9/1988 | Dash et al. | |
| 5,230,469 | A * | 7/1993 | Fisher | 238/210 |
| 5,503,331 | A * | 4/1996 | Uramson et al. | 238/152 |
| 5,918,806 | A | 7/1999 | Keightley et al. | |
| 2004/0155117 | A1 | 8/2004 | Urmson, Jr. et al. | |
| 2005/0098646 | A1 | 5/2005 | Urmson, Jr. et al. | |

OTHER PUBLICATIONS

Information from LBFoster website located at www.lbfoster.com/railproducts/products/toughcoat.html printed on Nov. 10, 2005.

Information from website of LBFoster Rail Products, located at www.lbfoster.com/railproducts/products/insulatedties.html printed on Nov. 10, 2005.

Website of Senecq Railroad and Mining, Inc. located at www.senecqrail.com/products.html, printed on Nov. 10, 2005.

(Continued)

*Primary Examiner*—S. Joseph Morano
*Assistant Examiner*—Robert J McCarry, Jr.
(74) *Attorney, Agent, or Firm*—Mahamedi Paradice Kreisman LLP

(57) ABSTRACT

An insulated rail joint assembly comprises a rail with a thick web section, held in place by joint bars and secured with electrically isolated fasteners. The joint bars have non-uniform cross-sections, being shaped with a thicker midsection area and thinner ends. Electrically non-conductive shear pins through the rail and the joint bars provide shear resistance and prevent glue bond failure. High strength cloth between the rail ends and between the rail and the joint bars strengthens the joint, as does an insulating rail clip resiliently fastened to an insulating tie plate, which itself may be supported on a cross tie of increased width.

28 Claims, 5 Drawing Sheets

OTHER PUBLICATIONS

Website of ANGI Srl, located at www.angisrl.com/prodotti/giuntiøl.htm, printed on Nov. 10, 2005.
Michael House, Taking Care of insulated joints . . . , located at www.findarticles.com/p/articles/mi_møBFN/is_5_101/ai_n13805581/print , printed on Nov. 10, 2005.
Website of LBFoster Rail Products, Years of Maintenance—Free sercice for lowest overall cost, located at www.lbfoster.com/railproducts/products/bondedjoint.html, printed on Nov. 10, 2005.
AREMA, Basic Track: Insulated Joints, located at www.arema.org/eseries/scriptcontent/custom/e_arema/Practical_Guide/PGChapter3.pdf , printed on Nov. 10, 2005.
Website of Coronet Rail Limited, The Coronet Joint, located at www.coronetrail.co.uk/drymech.html printed on Nov. 10, 2005.
"Tough coat" Insulated Joints by LBFoster, located at www.techsavvy.com/industry/file/national/ø83fr/lbfø7.html?id=113383&comp_id=ø83FR&base_region=*, printed on Nov. 10, 2005.
Bonded Insulated Joints by LBFoster, located at www.techsavvy.com/industry/file/national/ø83fr/lbfø6.html?id=1133828comp_id=ø83FR&base_region=*, printed on Nov. 10, 2005.
Eszter Ludvigh, Structures of Permanent way, located at www.vut.bme.hu/english/tplan2/LE_index.html printed on Nov. 10, 2005.

* cited by examiner

INSULATED RAIL JOINT ASSEMBLY

TECHNICAL FIELD OF THE INVENTION

This invention relates to an insulated rail joint assembly for use in railway track systems.

BACKGROUND OF THE INVENTION

A rail joint assembly connects adjacent rail sections together by mechanically splicing the rail ends. Prior art joint assemblies typically involve joint bars placed along the rails across the joint, on either side of the webs and secured by glue and/or bolts. A separator such as an end post, a gasket or other spacer may be placed between the rail ends. Reinforcing fiberglass cloth may be placed into the bond line between the rail ends and between the joint bar and rail to strengthen and insulate the joint.

Some applications require electrical insulation through the rail joint, such as for signaling, track movement or train location purposes. In those applications, insulating materials are used as separators between the rail ends, and may be also used to separate the joint bars from the rails.

One typical rail joint assembly is described in U.S. Pat. No. 3,100,080 to Fiechter which discloses a fishplate bonded to either side of a rail web, with a through-bolt securing the entire arrangement. The rail is supported on a tie, with a tie plate between the tie and the base of the rail. U.S. Pat. No. 3,381,892 to Eisses discloses another typical insulating rail joint assembly configuration, having a fishplate on either side of a rail web, with an insulating paste between the web and each fishplate.

The prior art arrangement gives rise to certain difficulties. Downward forces from passing trains deflect the rail, and tend to cause greater deflection at the weaker part of the rail, namely the joint. Glue at the bond lines of the joint creates a weak point, which is susceptible to cracking and failure.

The bond lines are also weak under thermal loads. As the ambient temperature changes, the rails contract and expand, creating a shear force along the bond lines, which in turn causes joint slip and failure.

Failure of the separator between the rail ends will decrease the insulating properties of the joint, leading to possible short circuits along the track. In addition, shorts between the joint bar and the rail can occur if the glue and insulating material between those pieces fails under repeated deflections. Bar-to-rail shorts are also a concern if uninsulated metal fasteners are inserted through bars and the rail web to hold the bars in place, or if the insulating means fail. Finally, in order to reduce wear on the joint, the joint preferably lies directly above a tie, preventing excess downward deflection under the weight of passing trains. However, while locating the joint over a tie helps support the joint, electrical shorts may be caused when the joint comes in contact with a typical steel tie plate.

As noted above, another concern is the failure of a rail joint along the bond line between the rail web and the joint bars. It is known to add a layer of fiberglass reinforcing material in the bond line to strengthen the joint. The inserted material may take the form of a fiberglass cloth, as disclosed in U.S. Pat. No. 4,466,570 to Howard. However, the addition of another layer at the bond line often simply provides another plane along which the joint can fail. For example, U.S. Pat. No. 5,503,331 to Urmson Jr. et al. discloses adding a layer of fiberglass matting material in a layer of adhesive bonding material, then adding more adhesive to strengthen the joint. Urmson Jr. recognizes that the adhesive layer is often compressed too much when the joint bars are tightened around the rail web, which tends to crush the matting and squeeze much of the adhesive out of the joint, thereby weakening the bond and adversely affecting the insulating properties. Urmson Jr. therefore discloses the use of embedded non-conductive spacers in the adhesive layer, which prevent such overcompression. Another means to strengthen the joint and provide insulation along the bond line may be a reinforcing plate, as disclosed in U.S. Pat. No. 4,630,772 to Watanabe et al.

The use of through-bolts or other fasteners to secure the joint bars in place on the rail webs may cause another weakness in the joint, namely the potential for failures and stresses around the holes through the rail web. Standard rail webs tend to be fairly narrow, compared to the size of the head of the rail or, often, the thickness of the joint bars, as can be seen in the figures of any of the prior art referred to herein. This means that stresses tend to concentrate around the holes through the narrow rail web, leading to cracks and other imperfections, followed by failure of the rail web. Failure of the rail through cracking and failure of the web around a bolt hole is often a problem.

The rail web is not the only component which may be prone to failure under repeated stress. The fasteners which hold the joint bars in place on the rail webs are also subject to stresses and may fail. In particular, it is known to provide some sort of electrical insulation about the head and shaft of the fastener in an insulated rail joint assembly, thereby insulating the metal fastener from the rail and from the joint bar. For example, U.S. Pat. No. 4,466,570 to Howard discloses insulating bushing around the through bolts, as does U.S. Pat. No. 4,773,590 to Dash et al. However, neither of these patents discloses a mechanism to protect these bushings from failure, or to ensure that the bolt is still insulated from the rail and joint bars should the bushing fail during use.

As noted above, while it may be preferable to fully support the rail joint with a cross tie, this arrangement can cause difficulties in that a metal tie plate or a steel cross tie may electrically short circuit with the rail. One method to overcome the problem with a steel tie is disclosed in U.S. Pat. No. 5,918,806 to Keightley et al. Keightley discloses a tie transversely cut into elongated members, wherein the members are then rejoined end to end with insulating material between the ends. However, this method is relatively complex and expensive, as the specially manufactured ties must be placed at the correct positions during the track laying process.

Another option to decrease the chances of rail-to-tie plate shorts is through the use of an insulator between the rail and the tie plate or of an insulating tie plate. U.S. Pat. No. 4,061,270 to Wandrisco discloses an insulating saddle to electrically insulate a steel tie from the rail and from any retaining elements used to hold the rail and saddle in place on the tie. However, the tie again is specially formed to include several detents to hold the saddle and other elements in place. LBFoster Rail Products advertises insulating tie plates made of solid polyurethane and of steel coated with polyurethane. Seneca Railroad and Mining, Inc. offers a polyurethane insulating tie plate, as well as a tie plate in a rubber/fiber combination. U.S. patent application Ser. No. 10/688,206 to Urmson Jr. also discloses a specially formed insulating tie plate.

It is therefore an object of the invention to provide an insulating rail joint assembly with an increased strength and deflection resistance at the joint, where it is most needed, without unduly increasing the overall size and weight of the joint bars.

It is a further object of the invention to provide an insulating rail joint assembly with improved strength and simple construction.

It is another object of the invention to provide an insulated rail joint assembly with a strong, cohesive bond line which is less prone to failure.

It is an object of the present invention to provide an improved insulated rail joint that overcomes the foregoing disadvantages and limitations.

These and other objects of the invention will be appreciated by reference to the summary of the invention and to the detailed description of the preferred embodiment that follow.

SUMMARY OF THE INVENTION

In one aspect, the invention provides an improved insulated rail joint assembly wherein a rail with a thick web section is added to a standard track, providing additional strength in the area of the joint, and increased resistance to concentrated stresses around the bolts holes in the web. Joint bars with non-uniform cross-sections are provided to impart additional strength and deflection resistance at the joint, without unduly affecting the overall size and weight of the joint bars or affecting the ease of installation of the joint assembly. The insulated rail joint assembly is supported on an insulating rail panel resiliently mounted on an insulating tie plate, which is in turn mounted on a standard tie. Fasteners to hold the joint bars in place are electrically floated and insulated from the joint bars and the rail. Electrically non-conductive shear pins may be provided between the rail web and the joint bars prevent joint slip and failure due to thermal loading. High strength inserts, such as aramid fiber cloths, are also contemplated between the joint bars and the rail to strengthen and support the joint assembly.

In one of its aspects, the invention comprises a rail joint assembly for a railway having two running rails of a pre-determined web thickness, the rail joint assembly comprising first and second rail segments, each having a web portion; a first joint bar fastened to and extending between the respective web portions of the first and second rail segments; wherein the web portions have a thickness greater than the pre-determined web thickness.

In a further aspect, the thickness of the web portions may be in the range of 1.5 to 2.5 times the pre-determined web thickness, and the pre-determined web thickness may be ⅝" to ¾".

In another aspect, the invention comprises a rail joint assembly comprising first and second rail segments, each having a web portion; a first joint bar fastened to and extending between the respective web portions of the first and second rail segments; and the web portions having a thickness of between 1½" and 2". The first joint bar may have a non-uniform cross-section, and in particular may comprise a midsection between two end sections, the midsection having a greater cross-sectional area than at least one of the end sections. The joint bar may further comprise a tapered portion between the midsection and the at least one end.

In a further aspect, the invention comprises rail joint assembly having an insulating adhesive layer between the first joint bar and the web portions of the first and second rails. The adhesive layer may further comprise cloth, which may be a reinforcing composite cloth.

In a further aspect, the invention comprises a rail joint assembly having at least one shear strengthener through the first joint bar and the first and second rail segments. The shear strengthener may be a non-conductive pin.

In another aspect, the invention comprises a rail joint assembly having a second joint bar, in opposed relation to the first joint bar across the web portions. Both first and second joint bars may have non-uniform cross-sections.

In another aspect, the invention comprises a rail joint assembly having a tie plate underlying the first and second rail segments; and resilient fasteners adapted to secure the tie plate and the first and second rail segments onto a tie. The resilient fasteners may comprise a plurality of springs, and more particularly, may comprise spring washers.

In another aspect, the invention comprises a joint bar for a rail joint assembly the joint bar having a length and comprising a midsection portion having a length and having a substantially constant cross-sectional area along the length of the midsection portion; opposed end sections, each having a length and having a substantially constant cross-sectional area along the lengths of the end sections; the cross-sectional area of the midsection portion being greater than the cross-sectional area of the end sections. The joint bar may further comprise at least one hole through the midsection portion adapted to receive fastening means therethrough In another aspect, the invention comprises joint bar for an insulated rail joint assembly, the joint bar having a length between two ends of the joint bar and comprising a midsection portion having a length and having a substantially constant cross-sectional area along the length of the midsection portion; opposed portions of the joint bar extending between the midsection portion and each of the ends of the joint bar; and all of the cross-sectional areas of the opposed portions being smaller than the cross-sectional area of the midsection portion. In a further aspect, each of the cross-sectional areas of the opposed portions may continuously taper from the midsection portion to one of the ends of the joint bar. Each of the opposed portions may comprise an end section having a length and having a substantially constant cross-sectional area along the length of the end section, and may further comprise a tapered portion between the midsection portion and each of the end sections. The length of the midsection portion may be substantially ⅓ of the length of the joint bar, and each of the tapered portions may be substantially ⅓ of the length of the joint bar.

In another aspect, the invention comprises a joint bar for an insulated rail joint assembly, the joint bar having a length and comprising first and second ends; a midsection having a constant cross-sectional area, the midsection commencing approximately at ⅓ of the length of the joint bar from the first end and ending at approximately ⅔ of the length of the joint bar from the first end; the midsection having a greater cross-sectional area than each of the first and second ends. The joint bar may further comprise a first tapered portion between the first end and the midsection, and a second tapered portion between the second end and the midsection.

In another aspect, the invention comprises an insulated rail joint assembly comprising first and second rail segments, each having a web portion having a thickness between 1½" and 2"; a first joint bar fastened to and extending between the respective web portions of the first and second rail segments; a second joint bar fastened to and extending between the respective web portions of the first and second rail segments, in opposed relation to the first joint bar across the web portions; each of the first and second joint bars comprising a midsection between two end sections, the midsection having a greater cross-sectional area than the maximum cross-sectional area of each of the end sections; and each of the first and second joint bars further comprising a tapered portion between the midsection and each of the end sections. Each of the first and second joint bars may further comprise a tapered portion between the midsection and each of the end sections. The rail joint assembly may further comprise at least one shear strengthener through the first and second joint bars and the first and second rail segments. The shear strengthener may comprise a non-conductive pin.

In yet another aspect, the invention comprises use of an insulated joint assembly in a railway between two running rails of a pre-determined web thickness, the insulated joint assembly comprising first and second rail segments, each having a web portion; and a first joint bar fastened to and extending between the respective web portions of the first and second rail segments; wherein the web portions of the first and second rails have a thickness greater than the pre-determined web thickness.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENT OF THE INVENTION

Figure 1:
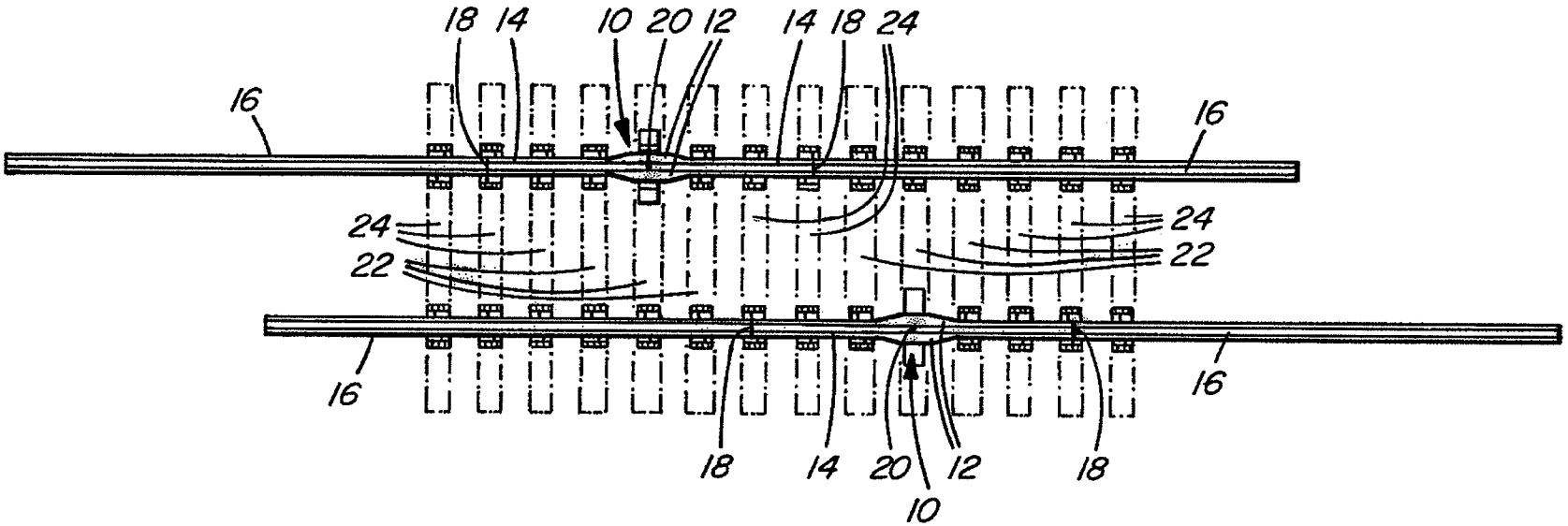
FIG. 1 is perspective view of a preferred embodiment of the insulated rail joint assembly in place on a railway track.

FIG. 1 shows the preferred embodiment of the insulated rail joint assembly 10 inserted into a standard railway track. The insulated joint assembly comprises two rail segments 14 and one or two joint bars 12, the joint bars 12 being fastened to and extending between the respective web portions 64 of said first and second rail segments 14. The joint bars 12 are installed at the abutment of the rail segments 14, against the web 64, and between the feet 68 and heads 70 of the rail segments 14. Rail segments 14 preferably have thick webs, relative to the pre-determined web thickness of the running rails 16. For example, in North America, standard running rails typically have web thicknesses ranging between ⅝" and ¾". Rail segments 14 preferably have web thicknesses of approximately 1.5 to 2.5 times the thickness of the running rails 16. For example, 136 TW rail segments may be used in an insulated joint assembly that is to be used between running rails having a web thickness of ⅝" to ¾. 136 TW rail segments have a standard web thickness of between 1½" and 2", or approximately 1 11/16". The insulated joint assembly 10 is installed into a section of standard track by any suitable method, such as butt welding, at seams 18.

In order to provide additional support and surface area between a tie and the underlying ballast, ties 22 are wider than the ties 24 in the standard track section. Wide ties 22 are preferably located directly underneath the center of joint assembly 10 and under the ends of joint bars 12. Additional wide ties 22 may be used along the railway if additional support is desired.

Figure 3:
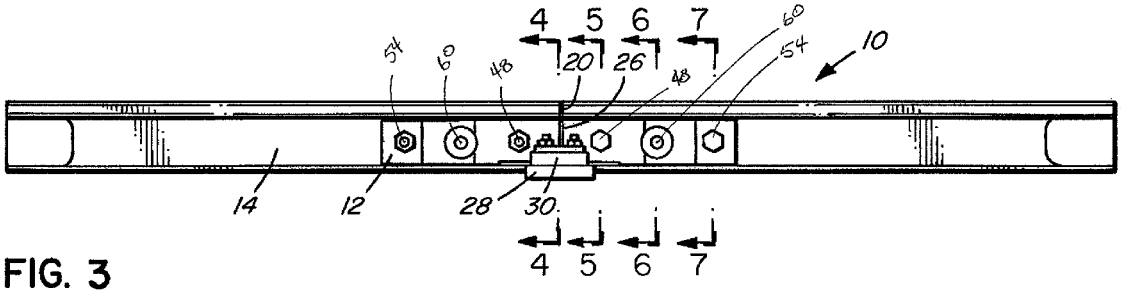
FIG. 3 is an elevation view of the insulated rail joint assembly of FIG. 2.
Figure 2:
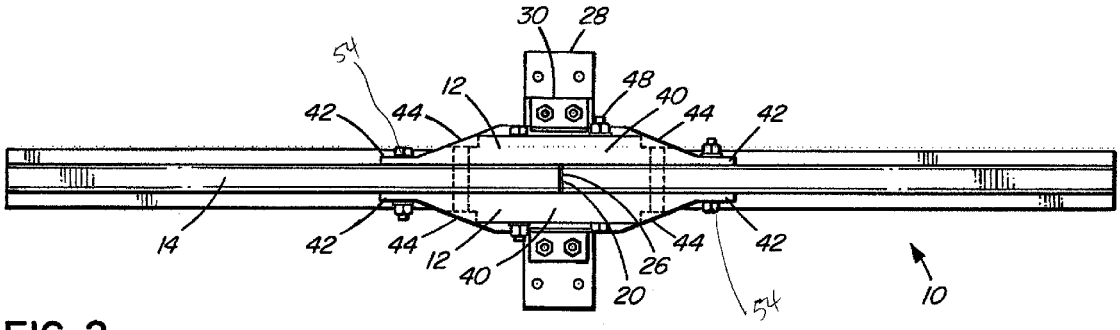
FIG. 2 is an enlarged perspective view of a preferred embodiment of the insulated rail joint assembly.

FIGS. 2 and 3 illustrate an embodiment of an insulated joint assembly 10 in more detail. At the joint 20, end post 26 separates the ends of rail segments 14. End post 26 may be made of any suitable insulating material, such as a pultruded composite, and is preferably machined to match the profile of rail segments 14. In the preferred embodiment, end post 26 is approximately ¼" thick, although any suitable thickness which will provide the desired insulating properties may be used.

Figure 4:
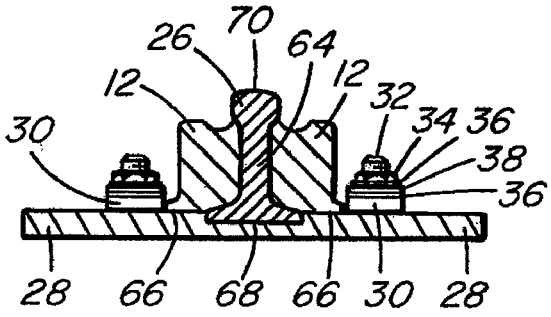
FIG. 4 is a sectional view of the insulated rail joint assembly, taken along line 4-4 of FIG. 3.

As best seen in FIG. 4, the joint assembly 10 rests on an insulating tie plate 28, and an insulating rail clip 30 secures the base 66 of joint bar 12. While any suitable fastening system may be used to secure the rail clip 30 and tie plate 28, the preferred embodiment of the assembly uses a resilient floating or elastic fastening system. The fastening system comprises one or more bolts 32 held in place with one or more nuts 34, and further securing one or more flat washers 36 around a double coil spring washer 38. The elastic fastening system allows the rail clip 30 to move with the rail 14 as it deflects under the force of passing train wheels without releasing or loosening the connection between the base of rail 14 and the rail clip 30, thereby resisting impact damage to the joint. Tie plate 28 and rail clip 30 may be made of any suitable insulating material, such as a pultruded composite.

Figure 5:
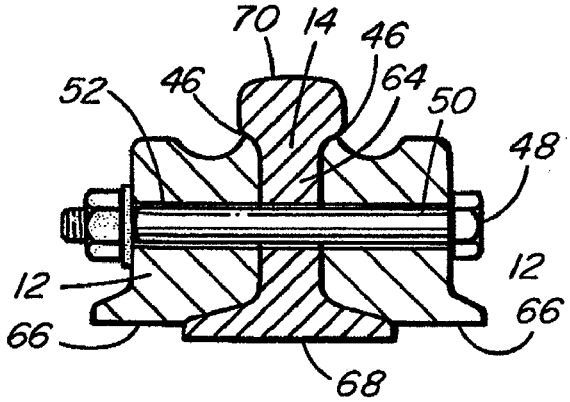
FIG. 5 is a sectional view of the insulated rail joint assembly, taken along line 5-5 of FIG. 3.
Figure 6:
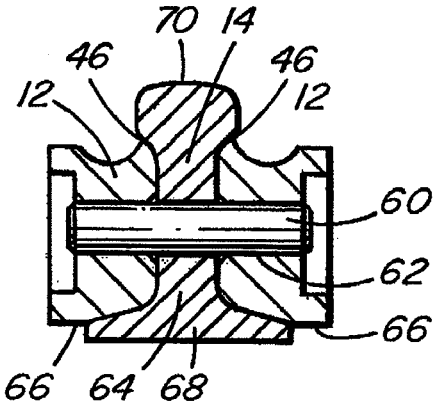
FIG. 6 is a sectional view of the insulated rail joint assembly, taken along line 6-6 of FIG. 3.
Figure 7:
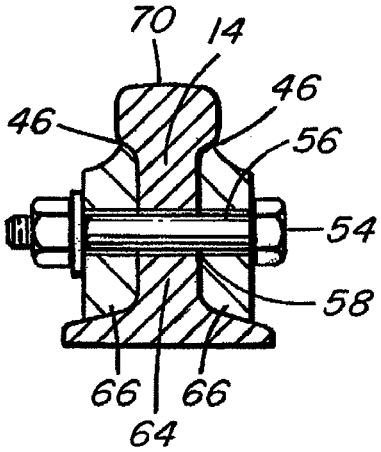
FIG. 7 is a sectional view of the insulated rail joint assembly, taken along line 7-7 of FIG. 3.

As best shown in FIGS. 5 through 7, joint bars 12 are fastened on either side of abutting rail segments 14 with one or more through fasteners. Joint bar 12 is secured to either side of the web 64 of rail 14, preferably resting on the foot 68 and under the rail head 70, providing a close fit between joint bar 12 and rail 14. A composite reinforcing cloth 46 may be glued between rail 14 and joint bar 12 to provide strength to the joint and to insulate the joint bar from the rail.

The strength of an insulated joint is generally limited by the strength of its glue bond, in that when the glue bond ruptures, then the joint has essentially failed. In addition to the composite reinforcing cloth 46 at the bond line, the glue bond may be reinforced by the use of one or more shear strengtheners to inhibit shear failure along the glue bond line. The shear strengtheners may take the form of shear pins 60 inserted into through holes 62 in joint bars 12 and rail web 64. Shear pins 60 are preferably made of non-conductive material, such as a pultruded plastic. Shear pins 60 may be precisely fitted into holes 62 by any appropriate method, such as by cooling them, thus shrinking the diameter of the shear pin 60 down slightly, and allowing the shear pin 60 to fit into through hole 62. Upon warming to ambient temperature, the shear pins 60 expand to their original size, making them very difficult to remove from holes 62. With the shear pins 60 in place, the shear pins 60 must fail, along with the glue bond, in order for the joint to fail, which substantially increases the strength of the joint. Shear pins 60 are more effective for this purpose than typical fasteners, which do not generally fit closely within the through holes in the joint bar and the rail, and therefore do not strengthen the glue bond in the same way as shear pins.

The strength of the glue bond may also be improved by the use of rails with thicker webs, which tend to have a web 64 more closely corresponding to the shape of the inner abutting surface of the joint bar 12. A closer fit between joint bar 12 and rail web 64 means more bonding surface between the joint bar 12 and rail web 64 which in turn produces a higher strength glue bond which can withstand higher loads.

Joint bars 12 are fastened in place with suitable fasteners. Because of the changing cross section of the joint bars 12, the fastener lengths vary. Long through-bolts 48 surrounded with long insulating bushings 50 are inserted into long through-holes 52 through the joint bars 12 and rail 14. Short through-bolts 54 surrounded with short insulating bushings 56 are inserted into short through-holes 58 through the joint bars 12 and the web 64 of rail 14. Insulated bushings 50, 56 prevents contact between metal through-bolts 48, 54 with the holes 52, 58 in the joint bars 12 and rail 14, thereby preventing electrical shorting.

The strength of a rail may be compromised by putting holes through the rail web 64. Stresses tend to concentrate at holes, causing cracks in the rail web and eventually leading to rail failure. The rail joint assembly of the present invention therefore uses a thicker rail web, which can dissipate stresses more easily than a standard thin web rail, and is therefore less susceptible to failure.

The preferred configuration of a joint bar 12 for use in the rail joint assembly is shown in FIGS. 8-12. Joint bar 12 has a non-uniform cross-section through its length. Preferably, joint bar 12 is thicker at the midsection 40, at or near the rail joint, providing increased strength and support in that area by providing an increased modulus. However, towards the end sections 42 of joint bar 12, less support is necessary, so the joint bar preferably has a somewhat smaller cross-section towards at least one of the opposed portions of the joint bar 12, which are end sections 42. End sections 42 have a length and preferably approximately constant cross-sectional area, but in any case have a maximum cross-sectional area which is smaller than the cross-sectional area of the midsection 40. Tapered sections 44 provide a transition between the joint bar midsection 40 and end sections 42.

Alternatively, it is contemplated that the configuration of joint bar 12 may comprise a step between midsection portion 40 and end sections 42, with no tapered portion, such that the cross-sectional areas of the opposed end sections 42 are substantially constant along the length of the end section. In the further alternative, end sections 42 of joint bar 12 may comprise a continuous taper from the midsection portion 40 to the ends of the joint bar 12.

The relatively thick midsection 40 of joint bar 12 has a higher section modulus than prior art joint bars, and therefore provides increased support for the joint at and around the abutment between the rail segments. The midsection 40 is preferably of constant cross-sectional area, to provide equal support to both sides of the joint. Thick midsection 40 tapers, through tapered sections 44, to thinner end sections 42. This configuration provides maximum support for the joint exactly where such support is required, without unduly increasing the overall weight and bulk of the joint bar 12.

Figure 8:
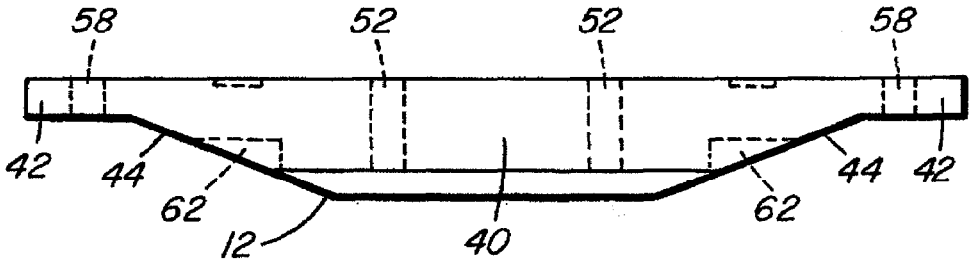
FIG. 8 is a perspective view of a preferred embodiment of a joint bar of the insulated rail joint assembly.
Figure 9:
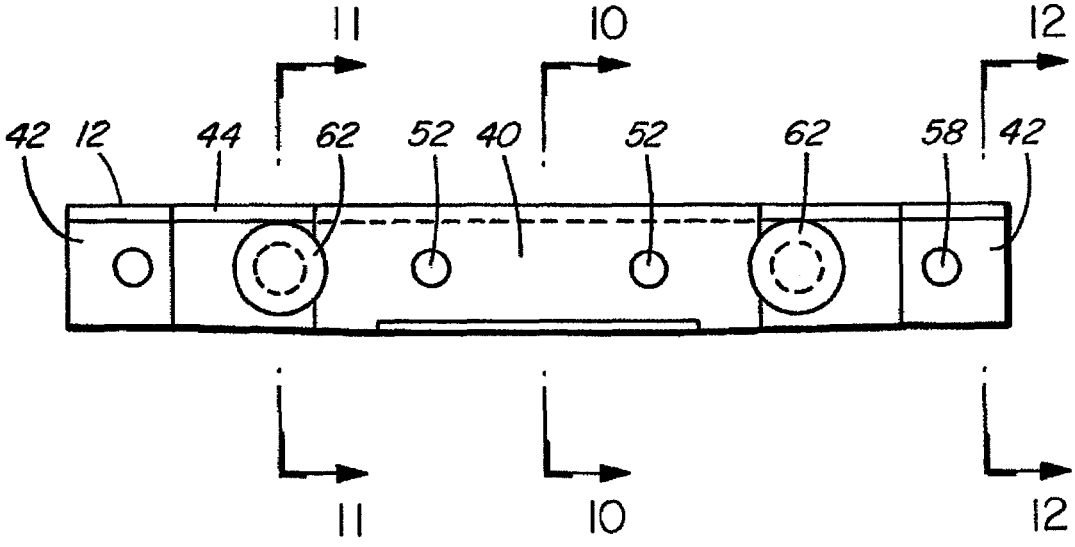
FIG. 9 is an elevation view of the joint bar of FIG. 8.
Figure 10:
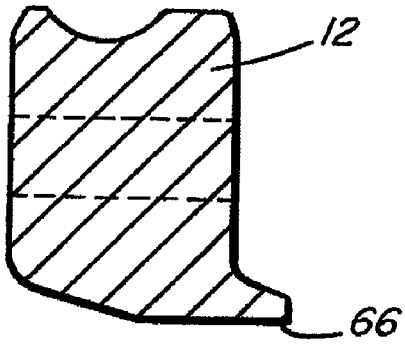
FIG. 10 is a sectional view of the joint bar, taken along line 10-10 of FIG. 9.
Figure 11:
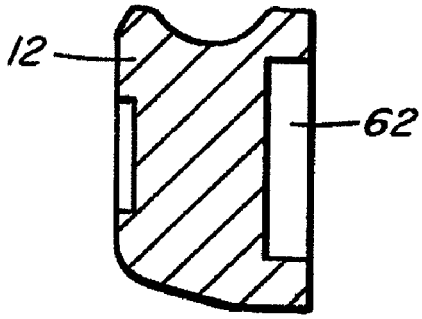
FIG. 11 is a sectional view of the joint bar, taken along line 11-11 of FIG. 9.
Figure 12:
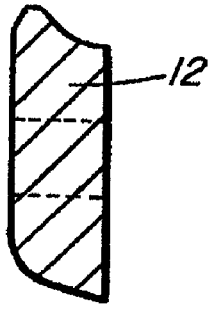
FIG. 12 is a sectional view of the joint bar, taken along line 12-12 of FIG. 9.

While it will be understood that the relative dimensions of the joint bar may vary depending on the particular railway system in which it is used, with reference to FIG. 8, the midsection 40 commences at approximately ⅓ of the length of the joint bar 12 from either end section 42 and ends at approximately ⅔ of the length of the joint bar 12 from that end section 42. Each tapered section 44 commences at approximately ⅔ of the length of the joint bar 12 from the opposite end. If a stepped or continuous taper configuration is used, the midsection may still comprise ⅓ of the overall length of the joint bar 12, with each of the stepped or tapered end sections 42 comprising another ⅓ of the joint bar 12.

It will be appreciated by those skilled in the art that other variations to the preferred embodiment described herein may be practised without departing from the scope of the invention, such scope being properly defined by the following claims.

The invention claimed is:

1. A rail joint assembly comprising:

first and second rail segments, each having a web portion, said web portions having a thickness of between 1½" and 2"; and a first joint bar fastened to and extending between the respective web portions of said first and second rail segments across a joint between said first and second rail segments;

wherein said first joint bar has a length and a non-uniform cross-section along said length, and further comprises a midsection between two end sections, said midsection having a greater cross-sectional area than at least one of said end sections.

2. The rail joint assembly of claim 1, wherein said joint bar further comprises a tapered portion between said midsection and said at least one end.

3. The rail joint assembly of claim 1 further comprising an insulating adhesive layer between said first joint bar and said web portions of said first and second rails.

4. The rail joint assembly of claim 3 wherein said adhesive layer further comprises cloth.

5. The rail joint assembly of claim 4 wherein said cloth comprises a reinforcing composite cloth.

6. The rail joint assembly of claim 1 further comprising at least one shear strengthener through said first joint bar and said first and second rail segments.

7. The rail joint assembly of claim 6 wherein said shear strengthener comprises a non-conductive pin.

8. The rail joint assembly of claim 1 further comprising a second joint bar, in opposed relation to said first joint bar across said web portions.

9. The rail joint assembly of claim 8 wherein said first and second joint bars have non-uniform cross-sections.

10. The rail joint assembly of claim 9 further comprising at least one shear strengthener through said first and second joint bars and said first and second rail segments.

11. The rail joint assembly of claim 10 wherein said shear strengthener comprises a non-conductive pin.

12. The rail joint assembly of claim 1, further comprising:

a tie plate underlying said first and second rail segments; and resilient fasteners adapted to secure said tie plate and said first and second rail segments onto a tie.

13. The rail joint assembly of claim 12 wherein said resilient fasteners comprise a plurality of springs.

14. The rail joint assembly of claim 13 wherein said springs comprise spring washers.

15. A joint bar for an insulated rail joint assembly, said joint bar having a length between two ends of said joint bar and comprising:

a midsection portion having a length and having a substantially constant cross-sectional area along said length of said midsection portion;

opposed end sections, each having a length extending between one of said ends of said joint bar and said midsection portion and having a substantially constant cross-sectional area along said lengths of said end sections;

said cross-sectional area of said midsection portion being greater than the said cross-sectional area of said end sections.

16. The joint bar of claim 15, further comprising at least one hole through said midsection portion adapted to receive fastening means therethrough.

17. A joint bar for an insulated rail joint assembly, said joint bar having a length between two ends of said joint bar and comprising:

a midsection portion having a length and having a substantially constant cross-sectional area along said length of said midsection portion;

opposed portions of said joint bar extending between said midsection portion and each of said ends of said joint bar; and all of the cross-sectional areas of said opposed portions being smaller than said cross-sectional area of said midsection portion.

18. The joint bar of claim 17 wherein each of said cross-sectional areas of said opposed portions continuously tapers from said midsection portion to one of said ends of said joint bar.

19. The joint bar of claim 17 wherein each of said opposed portions comprises an end section having a length and having a substantially constant cross-sectional area along said length of said end section.

20. The joint bar of claim 19, further comprising a tapered portion between said midsection portion and each of said end sections.

21. The joint bar of claim 20, wherein the length of said midsection portion is substantially ⅓ of said length of said joint bar.

22. The joint bar of claim 21, wherein each of said tapered portions is substantially ⅓ of said length of said joint bar.

23. A joint bar for an insulated rail joint assembly, said joint bar having a length and comprising:

first and second ends;

a midsection having a constant cross-sectional area, said midsection commencing approximately at ⅓ of the length of said joint bar from said first end and ending at approximately ⅔ of the length of said joint bar from said first end;

said midsection having a greater cross-sectional area than each of said first and second ends.

24. The joint bar of claim 23, further comprising a first tapered portion between said first end and said midsection, and a second tapered portion between said second end and said midsection.

25. An insulated rail joint assembly comprising:

first and second rail segments, each having a web portion having a thickness between 1½" and 2";

a first joint bar fastened to and extending between the respective web portions of said first and second rail segments across a joint between said first and second rail segments;

a second joint bar fastened to and extending between the respective web portions of said first and second rail segments, in opposed relation to said first joint bar across said web portions and said joint;

each of said first and second joint bars comprising a midsection between two end sections, said midsection having a greater cross-sectional area than the maximum cross-sectional area of each of said end sections; and each of said first and second joint bars further comprising a tapered portion between said midsection and each of said end sections.

26. The rail joint assembly of claim 25 wherein the insulated joint is for a railway having two running rails of a pre-determined web thickness, and said thickness of each of said web portions is between 1.5 and 2.5 times said pre-determined web thickness.

27. The rail joint assembly of claim 25 further comprising at least one shear strengthener through said first and second joint bars and said first and second rail segments.

28. The rail joint assembly of claim 27 wherein said shear strengthener comprises a non-conductive pin.

* * * * *